US007854392B2

(12) United States Patent
Hauschild et al.

(10) Patent No.: US 7,854,392 B2
(45) Date of Patent: Dec. 21, 2010

(54) SYSTEM FOR FASTENING A RAIL FOR A RAIL VEHICLE

(75) Inventors: Georg Hauschild, Aachen (DE); Dirk Vorderbrück, Werdohl (DE); Roland Buda, Kierspe (DE); Gerold Böhm, Balve (DE); Peter Van Bommel, Werdohl (DE); Dierk Bressel, Dortmund (DE)

(73) Assignee: Vossloh-Werke GmbH, Werdohl (DE)

( * ) Notice: Subject to any disclaimer, the term of this patent is extended or adjusted under 35 U.S.C. 154(b) by 560 days.

(21) Appl. No.: 11/632,154

(22) PCT Filed: Jul. 8, 2005

(86) PCT No.: PCT/EP2005/007421

§ 371 (c)(1),
(2), (4) Date: Jan. 9, 2008

(87) PCT Pub. No.: WO2006/005543

PCT Pub. Date: Jan. 19, 2006

(65) Prior Publication Data

US 2008/0237363 A1 Oct. 2, 2008

(30) Foreign Application Priority Data

Jul. 13, 2004 (DE) ..... 10 2004 033 724

(51) Int. Cl.
*E01B 9/00* (2006.01)

(52) U.S. Cl. ..... 238/349; 238/351; 238/352

(58) Field of Classification Search ..... 238/310, 238/381, 349, 351, 352
See application file for complete search history.

(56) References Cited

U.S. PATENT DOCUMENTS 4,632,307 A * 12/1986 Weber ..... 238/265
4,705,215 A * 11/1987 Eisenberg et al. ..... 238/349

(Continued)

FOREIGN PATENT DOCUMENTS

DE 3423997 A1 1/1986

(Continued)

*Primary Examiner*—Mark T Le
*Assistant Examiner*—Jason C Smith
(74) *Attorney, Agent, or Firm*—Proskauer Rose LLP

(57) ABSTRACT

A system for fastening a rail includes a sleeper having a supporting face supporting the flange of the rail and merging at its sides into respective levelling faces situated at a higher level than the supporting face, an angled mounting plate having a central portion on the underside of which is formed a support surface by which the angled mounting plate can be placed down on the respective levelling face assigned thereto, a supporting portion formed onto the central portion and pointing downwards from the underside of the latter and which can bridge a clear space between the flange of the rail and the levelling face, a resilient member which can be placed down on the angled plate and has two holding arms by which the resilient member can exert a holding force on the rail, and a clamping member which can exert a clamping force on the resilient member.

35 Claims, 5 Drawing Sheets

U.S. PATENT DOCUMENTS

| | | | | |
|---|---|---|---|---|
| 4,907,740 | A * | 3/1990 | Oberweiler et al. | 238/283 |
| 5,042,717 | A | 8/1991 | Vanotti | |
| 5,096,119 | A * | 3/1992 | Schultheiss et al. | 238/349 |
| 6,257,495 | B1 * | 7/2001 | Eisenberg | 238/349 |
| 7,389,940 | B2 * | 6/2008 | Kurzo | 238/310 |
| 7,637,438 | B2 * | 12/2009 | Schwiede et al. | 238/349 |
| 2004/0069858 | A1 * | 4/2004 | Tan et al. | 238/310 |
| 2008/0093472 | A1 * | 4/2008 | Hohne et al. | 238/351 |
| 2008/0237363 | A1 * | 10/2008 | Hauschild et al. | 238/349 |
| 2008/0257972 | A1 * | 10/2008 | Vorderbruck et al. | 238/331 |
| 2009/0084864 | A1 * | 4/2009 | Bosterling et al. | 238/349 |
| 2009/0308943 | A1 * | 12/2009 | Wirthwein et al. | 238/310 |

FOREIGN PATENT DOCUMENTS

| | | | |
|---|---|---|---|
| DE | 20304291 | U1 | 6/2003 |
| FR | 2239560 | A | 2/1975 |
| FR | 2634801 | A1 | 2/1990 |

* cited by examiner

SYSTEM FOR FASTENING A RAIL FOR A RAIL VEHICLE

BACKGROUND

The invention relates to a system for fastening a rail, which has a sleeper which has a supporting face intended to support the flange of the rail, the supporting face merging, at its sides which extend parallel to the longitudinal extent of the rail to be fastened thereto, into respective levelling faces which are situated at a higher level than the supporting face, an angled mounting plate which has, in each case, a central portion, on the underside of which is formed a support surface by which the angled mounting plate can be placed down on the respective levelling face assigned to it of the sleeper, and a supporting portion which is formed onto the central portion and points downwards from the underside of the latter and which, when the system is fully fitted, bridges the clear space between the flange of the rail and the levelling face, a resilient member which can be placed down on the angled plate and which has, in each case, two holding arms by which, when the system is fully fitted, the resilient member exerts a holding force on the rail, and a clamping member which, when the system is fully fitted, exerts a clamping force on the resilient member.

Rails for rail vehicles usually have a rail flange, with which they stand on the respective surface, a rail stem of small thickness, which rail stem is mounted on the rail flange and a rail head supported by the rail stem, on the upper side of which rail head the rolling surface for the wheels of the rail vehicle is formed. When rolling over such a rail, high strains occur not only due to the weight of the rail vehicle, but the rail is also subjected to high dynamic forces, which occur due to the speed, with which the rail vehicle rolls over the rail. Since the forces acting on the rail during rolling over lead to a considerable deformation of the rail in the moment of rolling over, form and material of the rail are designed such, that the rail can accommodate these deformations also over a large operation period. To this end, however, the rail must also be able to deform and move in the area of its fastenings.

In order to achieve this, a fastening system is required which, on the one hand, holds the rail elastically in the vertical direction such, that its secure fastening on the sleeper is assured and at the same time a sufficient flexibility is present. On the other hand the fastening system applied in each case must be able to absorb the large lateral forces, which are transferred to the rail by the rail vehicle during rolling over.

A fastening system reliably used many times in practice, which fulfils the above mentioned requirements, is known from the setup instruction "Schienenbefestigungssystem W14", which has been published by the applicant for example with the URL "http://www.vossloh-rail-systems.de".

The W14 rail fastening system is based on a concrete sleeper, into which an even supporting face for the flange of the respective rail to be fastened is formed. Seen in the longitudinal direction of the rail to be fastened, the supporting face thereby extends over the entire sleeper, while its width, measured transversely to the longitudinal extent of the rail, corresponds approximately to the width of the rail flange. At its two narrow sides the supporting face merges into a respective levelling face which is situated on the same level as the supporting face. Connected to the levelling faces in each case at their narrow side remote from the supporting face is a groove extending over the sleeper and parallel to the longitudinal extent of the rail to be fastened, which groove has an essentially V-shaped cross section.

Additionally, in a central position a reception for a plug or the like is formed into the levelling faces, into which plug a clamping screw can be screwed.

For fastening the rail a so called "angled mounting plate" is placed down onto the levelling faces of the sleeper. These angled mounting plates, which for weight reasons are usually made of a high-strength plastics material, have a central portion, on the underside of which a support surface is formed, with which support surface the angled mounting plate can be placed down onto the respective levelling face assigned to it of the sleeper.

In the angled mounting plate used for the system W14 a supporting portion is formed onto the central portion, which supporting portion, starting from the support surface on the underside of the angled mounting plate, extends downwards and whose form is adapted to the form of the grooves formed into the sleepers. In the mounted position each angled mounting plate sits form-fit in the respective groove assigned to it. With its side lying opposite the supporting portion, however, the angled mounting plates abut laterally against the flange of the rail to be fastened. Lateral forces, which are transferred by the rail onto the angled mounting plate, can thus be absorbed by the angled mounting plate and directed into the sleeper. The support of the angled mounting plates is thereby effected by the side face of the respective groove facing away from the rail.

In order to securely transfer the lateral forces originating from the rail during driving operation onto the respective side face of the groove, the angled mounting plates must have a sufficient strength and form stability. This requirement results in the angled mounting plates used in the known fastening systems, despite them being made of plastics material, having a considerable weight. Also, the plastics used for their production must themselves be resistant in a sufficiently high and long-lasting manner.

For securing the rail against taking off, resilient members are usually used in the known rail fastening systems, which resilient members are made of spring steel. In the rail fastening system W14 as resilient members so called "tension clamps" are used, which are bent from a rod steel. These tension clamps are formed W-shaped and are clamped on the angled mounting plate with their central portion. To this end in the angled mounting plate a through-opening is formed, through which the clamping screw used for clamping the respective tension clamp can be screwed into the respective plug inserted into the sleeper.

After finishing assembly, the tension clamp, in this state being clamped against the sleeper, sits with its holding arms, extending from the central portion, on the flange of the rail to be fastened. The holding arms thus exert elastic forces onto the flange, which forces are on the one hand strong enough in order to prevent excessive taking off of the rail, but on the other hand are so elastic that the rail can sufficiently move up and down in the vertical direction during rolling over of a rail vehicle. In this manner the rail is securely held and can nevertheless compensate its deformations caused by the weight and the driving movement of the rail vehicle.

In order to be able to exert the elastic forces, necessary for holding the rail, durably and securely the tension clamps used in the fastening system W14 and comparably constructed systems each feature a complex form. Thus, the legs of the usually U-shaped central portion at their ends are bent towards each other, so that the clear space remaining between them is smaller than the diameter of the clamping screw used for clamping the tension clamp. In this manner, in the assembled position, the central portion loops around the clamping screw in a securing manner.

From the narrowing area thus formed, the legs of the central portion, in a bending, leading downwards and outwards, respectively lead into a torsion portion, which in the further progression is bent straight. To the two torsion portions of the tension clamp, in a further bending a holding arm is respectively connected, which holding arm, in the non-fastened state, has an arching which, seen in the lateral direction, extends over approximately 160°. In this fashion, when the tension clamp is preassembled on the angled mounting plate, the free ends of the holding arms lie underneath the level of the central portion.

Via a further bending, the free ends of the holding arms each merge into a bending, which bendings, in the plan view, are arranged essentially at a right angle with respect to the central portion of the tension clamp. The free distance between the central portion and the bendings at the end of the holding arms is thereby smaller than the smallest diameter of the tension clamp. In this way it is secured that tension clamps, being collected in a larger container, can not interlock with each other.

Tension clamps of the type described above have proved themselves particularly in the area of such track lines, which are driven in mixed operation, i.e. by high speed trains as well as by heavy load trains. It is contrary to this success, however, that the tension clamps fatigue after a certain operation time and must be replaced. Further, due to their complex form, their production is relatively expensive.

A rail fastening system of the type mentioned above is known from FR 26 34 801 A1. This known fastening system is also based on a concrete sleeper, into which a support surface, extending transversely to the longitudinal extension of the rail to be fastened, is formed. Unlike with the fasting system W14 described above, in this case the support surface is broader than the width of the rail flange. On its narrow sides, extending parallel to the longitudinal extension of the rail to be fastened, the support surface respectively merges in a step into a levelling face, which levelling face, in relation to the level of the support surface, is situated higher than the support surface. In the area of the step a force-carrying face, being positioned essentially at a right angle to the support surface, is formed. In the area between the rail flange and the two steps, also remaining free after assembly, in each case a reception for a plug is formed into the support surface, into which a clamping screw can be screwed.

For fastening the rail, also in the system known from FR 26 34 801 A1 an angled mounting plate is provided. This angled mounting plate, being formed rectangular in the plan view, has a central portion, onto whose one narrow side a supporting portion, extending downwards from the central portion, is formed. In the corner areas of the side facing away from the supporting portion, onto the evenly formed upper side of the angled mounting plate, additionally a guide portion is formed in each case. Both guide portions, with their free ends, extend beyond the central portion. Finally, in a central position a through-opening is formed into the angled mounting plate, through which the clamping screw can be screwed into the plug respectively provided in the sleeper, when the angled mounting plate is positioned on the sleeper.

As a resilient member, in the fastening system known from FR 26 34 801 A1, two flat sheet elements of different length are used, which act in the fashion of a leaf spring.

In the ready mounted state of the system known from FR 26 34 801 A1 an angled mounting plate respectively sits in one of the spaces remaining free in the area of the support surface at the side of the rail. The angled mounting plates thus bridge over the distance between rail flange and step, so that their supporting portion, with its contact surface, abuts the force-carrying face, assigned to it, of the sleeper, while the central portion, with its side face facing away from the supporting portion, laterally abuts the rail flange. In this case the guide portions of the angled mounting plates lie on the rail flange, so that the angled mounting plate stands on the support surface in the area of its supporting portion only.

In this assembly state, the upper side of the angled mounting plates is positioned slightly lower than the level of the respective levelling face of the sleeper. On the upper side of the angled mounting plates, in each case the longer of the resilient members is arranged such, that with its one end it is supported on the rail flange and with its other end it is supported on the levelling face. The shorter member is positioned on the longer resilient member. Both resilient members are respectively clamped by a clamping screw acting as a clamping element, which clamping screw is screwed into the sleeper through the resilient members and the respective angled mounting plate. The plate-like resilient members thus, in the fashion of a leaf spring, exert the required elastic holding forces onto the rail flange.

Rail fastenings of the type known from FR 26 34 801 A1 are used in the area of tracks, which are exclusively driven in high speed operation. For the stresses and deformations of the rail thereby occurring, the elasticity of the known system suffices. However, for tracks driven in mixed operation this known system proves not to have sufficient fatigue strength. In particular, the overall elasticity of the system is not high enough, in order to secure a sufficient movability of the rail at the same time as sufficiently high holding forces in heavy load operation.

Apart from the above explained prior art, from practice a fastening system is known, in which a resilient member of the type mentioned initially, offered under the designation "Spannklemme SKL2", is used. This tension clamp has a U-shaped central portion, whose legs extend parallel, and at their ends respectively merge into a respective holding arm in a continuous bending leading outwards without deviations. Starting from the end of the straight leg carrying it, each holding arm is bent by approximately 185°, so that its free end is respectively arranged obliquely with respect to the leg concerned, and the imaginary extensions of the holding arms, in the plan view, intersect in a point, which lies far outside the central portion.

The radius of the bending of the holding arms thereby corresponds precisely to the radius, by which the U-shaped central portion is bent between its legs. The diameter of the partial circle, in each case encompassed by the holding arms, is thus the same as the clear width between the legs of the central portion. Since at the same time the length of the legs of the central portion approximately corresponds to twice the clear width between them, the free ends of the holding arms, in the plan view, are approximately positioned at the level of the position, at which the holding arms are connected to the respective leg carrying them. Thereby the holding arms, seen in their mounted position, are inclined downwards approximately after half of the bending fulfilled by them.

For fastening a rail with the aid of one of the above described SKL2 tension clamps, a so called "fin plate" is mounted on a sleeper. This fin plate carries a fin being aligned parallel to the longitudinal extent of the rail. After positioning the rail to be fastened, the known tension clamp, with its middle section, is placed on the fin such, that the clamp's bent partial section, connecting the legs of the central portion, lies on the fin facing away from the rail, while the free ends of the holding arms stand on the rail flange. With the aid of a pressure plate and a clamping screw the tension clamp is then clamped against the fin plate, so that, via its holding arms, it exerts the necessary elastic holding force onto the rail flange.

In practical operation the long legs of the known tension clamp are subject to work done on bending and torsion. This mixed stress leads to a limited fatigue strength of the known tension clamp. Furthermore, the relatively short holding arms, also in combination with the long legs of the central portion, in particular during the high required holding forces during heavy load or high speed operation, do not provide sufficient elastic flexibility, in order to permanently secure the necessary movability of the rail in the vertical direction at the same time as a reliable holding.

Starting from the prior art described above it was the object of the invention to provide a system for fastening rails, which can be manufactured cost-efficiently, and which, besides being able to be permanently loaded in an improved manner and exhibiting a prolonged lifetime of its components, is able to exert high holding forces at optimised elastic properties.

Starting from the prior art explained above this object has been met by a system of the initially mentioned type, which according to the invention is characterised in that, when the system is fully fitted, the axis along which the clamping force exerted by the clamping member acts passes through the levelling face.

In a system according to the invention, unlike in the prior art, the lateral forces exerted by the rail during operation are transferred by the angled mounting plate into the sleeper at a position, which lies in front of the area, in which the clamping member, used for clamping the resilient member, is mounted on the respective sleeper. This leads to the clamping means themselves remaining essentially free from lateral forces. The same applies to the parts of the angled mounting plate, which lie beyond the border of the transition of the support surface to the levelling face. These can therefore be accomplished in a particularly simple manner. Since the angled mounting plate does not have to exert lateral forces in the area lying on the levelling face, it can, without constrains, be designed such, that it has optimum guiding properties for the resilient member being respectively supported on it. Since due to the force introduction according to the invention also the lateral relative movements between the resilient member and the angled mounting plate, the clamping element and the angled mounting plate as well as the angled mounting plate and the sleeper can be reduced to a minimum, the abrasive wear of the angled mounting plate and the sleeper is also reduced to a minimum.

As a result, thus a system for fastening a rail is provided, which is optimised with regard to its functioning, its weight and the lifetime of its components, which can be produced at reduced costs and at the same time possesses optimised using properties.

The acting principle underlying the system according to the invention can be realised in practice for example by using a sleeper, which has a supporting face intended to support the flange of the rail, the supporting face merging, at its sides which extend parallel to the longitudinal extent of the rail to be fastened thereto, into respective levelling faces which are situated at a higher level than the supporting face, wherein there is associated with each levelling face a formed element for fastening a clamping member in place, which clamping member, when the rail is fitted, holds clamped, with a clamping force, a resilient member which exerts a holding force on the rail, and in that, in relation to the transition between the supporting face and the levelling face associated therewith, each of the formed elements is arranged to be spaced away from the supporting face in the direction of the levelling face concerned in such a way that, when there is a clamping member fastened to the sleeper, the axis along which the clamping force produced by the clamping member acts passes through the levelling face associated with the given formed element.

In a sleeper thus designed, the introduction of the force needed for clamping the respectively used resilient member occurs at a position of the sleeper, which lies beyond the border of the transition of the supporting face to the levelling face. Accordingly, the position provided at the sleeper for fastening the clamping member lies at least on the border of the transition between the supporting face and the levelling face, and in this case such, that the axis, via which the force exerted or absorbed by the clamping member acts, does not extend through the supporting face but first through the levelling face. Such a sleeper is provided such that the force clamping the resilient member, seen from the supporting face, is introduced into the sleeper behind that surface, which limits the supporting face in the area of the transition to the levelling face. Thus, it is possible to support an angled mounting plate, provided for lateral support of the rail, in the area of the transition, without the means provided for clamping the resilient member being stressed.

A particularly good introduction of the lateral forces coming from the rail during operation into the sleeper can in this connection be achieved by the transition between the supporting face and the levelling face being of a stepped form. For this purpose the force-carrying face laterally limiting the supporting face in the area of the transition to the levelling face is arranged such, that the angle made between the lateral face and the supporting face is 75° to 105°, particularly 85° to 95°.

The form of the levelling face of the sleeper used preferably is generally dependent on the outlay of the angled mounting plate used for fastening the rail, the corresponding resilient member and the clamping means, which is used for clamping the resilient member. A particularly simple outlay results in this context when the supporting face and the levelling face are positioned in planes arranged parallel to one another.

The collection of water on the sleeper can be counteracted if at least one of the surfaces which adjoin the levelling face and are remote from the supporting face is formed to slope down from the levelling face. Thereby it is favourable if the surface which adjoins the levelling face merges steplessly into the levelling face, so that rain water hitting the levelling face can drain off unobstructedly.

The sleeper used in a system according to the invention is preferably produced from a concrete material, which is economically available and possesses the toughness required for receiving the forces. Alternatively the sleeper can also be produced from a suitable plastics material or a mixed material from plastics material and concrete material. The concrete material can further contain reinforcement components such as carbon fibre, glass fibre or the likes.

As a forming element for fastening the clamping member an opening can be formed into the sleeper of the above scribed type, used in the system according to the invention, into which for example a plug for a screw serving as clamping member can be inserted. Alternatively for fastening the clamping member clips, bows, pins, hunches or comparable elements can be formed onto the sleeper or be provided in other ways, which elements receive the forces required for clamping the resilient member.

An angled mounting plate preferably used in the fastening system according to the invention is characterised in that the angled mounting plate has a central portion, on the underside of which is formed a support surface by which the angled mounting plate can be placed down on a levelling face of the sleeper, and a supporting portion which is formed onto the central portion and points downwards from the underside of the latter, which supporting portion has a first contact face which comes to bear against the rail in the fitted position, and a second contact face situated opposite which rests against the sleeper in the fitted position, and a through-opening formed in the central portion for a clamping member, the centre axis of which through-opening, passing through the central portion, extends outside the supporting portion and adjacent to the latter's second contact face.

The form of such an angled mounting plate allows for the mounting plate to be mounted such, that the lateral forces originating from the rail to be fastened in operation are transferred to the sleeper via the supporting portion only, which sleeper carries the rail and the components used for its fastening. In order to achieve this, the supporting portion according to the invention is formed onto the central portion of the angled mounting plate at a position, which in the fitted state of the mounting plate with respect to the rail to be fastened lies in front of the central axis of the through-opening of the mounting plate, which axis is guided through the central portion. The central portion of the angled mounting plate, however, remains essentially free from the lateral forces. Thus, it is exclusively available for guiding a resilient member, which can be mounted on the angled mounting plate and which exerts the necessary holding forces in the vertical direction for holding the rail. In order to securely hold and guide the resilient member, only small material amounts are required in the area of the central portion, so that such an angled mounting plate has a considerably smaller weight compared with the known angled mounting plates fulfilling a corresponding functional range.

Together with the material saving achieved in the manner described above angled mounting plates designed in such a way have an increased lifetime. This is also achieved in that only the supporting portion is subjected to the forces directly emanating from the rail, while the central portion is essentially only loaded with the clamping force acting on the resilient member. Mixed loads, as they were unavoidable in the prior art, thus, if at all, only occur to small extents, so that in particular the abrasive wear due to relative movements between the angled mounting plate and the sleeper is reduced to a minimum.

Particularly good conditions in the transfer of the forces originating from the rail can be achieved, if the angle made between the support surface and the second contact face of the supporting portion is 75° to 120° and in particular 100° to 115°.

An improved protection against twisting, slipping or spreading of the resilient member to be mounted on the angled mounting plate can further be achieved, if additionally to the other features of the angled mounting plate, on its upper side opposite from the underside, the central portion has formed elements for guiding of a resilient member for applying a holding force to the rail, which resilient member can be placed down on the angled mounting plate.

These formed elements can for example be constructed in the form of legs connected to the central portion, which legs follow the form of the resilient member to be fastened on the angled mounting plate.

For improving the isolation of the angled mounting plates a collar, which extends round the edge of the through-opening at least in portions, can be formed on the underside of the angled mounting plate. In the fitted angled mounting plate, this collar then sits in a corresponding reception of the sleeper, into which also the clamping means used for clamping the respective resilient member engages.

For improving the guiding of the resilient member in the clamped state as well as for protection against the penetration of moisture, which collects on the angled mounting plate, into the area of the through-opening it can be favourable, to provide in the region of that edge of the through-opening which is associated with the upper side of the central portion, a collar projecting from the upper side. This collar also preferably extends round the edge of the through-opening.

Further weight savings can be accomplished in that the width of the central portion is dimensioned smaller than the width of the support portion.

Angled mounting plates used in a system according to the invention are preferably produced from a plastics material. However, other materials, such as metals and comparable materials, can also be used if the forces occurring in operation require it.

A resilient member particularly suitable for use in a fastening system according to the invention is characterised in that the resilient member has a U-shaped central portion whose legs merge into a respective one of holding arms, which holding arms, starting from the legs of the central portion which are respectively associated with them and moving away in a lateral direction, are bent into a curve which extends continuously and without deviations through more than 180°, and whose radius is more than half the clear width between the legs of the central portion. Such a resilient member is characterised firstly in that its holding arms extend from the U-shaped central portion of the resilient member in a continuous bending, having constantly the same curvature. Thereby the radius, with which the holding arms are bent, is so large, that the clear width of the space respectively limited by the holding arms is greater than the distance between the legs themselves. Through this forming in the area of the bent holding arms a great length is available, over which the holding arms are elastically flexible. The form of the holding arms bent in a large radius leads to the holding arms, in the loaded state, essentially only being subjected to torsional strain. Since at the same time the length of each leg of the central portion is short compared with the length of the holding arm respectively connected to it, these legs also are only negligibly loaded with bending stress in the fully fitted state. A mixed load affecting the bending endurance is thus avoided, so that such a resilient member can be used over an operational time considerably longer than known resilient members.

Thereby, the resilient member preferably used in a system according to the invention has an improved operational reliability compared with the prior art. Due to the wide extent of the holding arms the central portion of such a resilient member can be mounted without problems such, that it forms a protection against tilting of the resilient member under the forces occurring in practical operation.

A further advantage of the above described resilient member lies in the amount of material needed for its production is reduced to a minimum. Therefore, also the weight of such a resilient member is considerably reduced in comparison with the weight of known resilient members of similar capacity.

The elasticity, with which the resilient member is capable of exerting the holding force produced by it, can be optimised in that seen in the plan view, the extent, as measured parallel to a given leg of the resilient member, of the region which is defined by the holding arms is in each case greater than the length of that leg of the central portion which is associated with the given holding arm. This embodiment further enables a simple fitting of the resilient member, since the holding arms can be placed onto the flange of the rail to be fastened in an easy manner, and at the same time sufficient space is available for fastening the central portion. It serves the same purposes if the bending of the holding arms is made such, that its free ends are directed towards the central portion.

SUMMARY OF THE INVENTION

According to a preferred embodiment, seen in the plan view, the curvature of each of the holding arms of a resilient member used in a fastening system according to the invention describes respectively at least a part-circle. With this forming an approximately equally distributed torsional stress of the holding arms over their entire length is achieved, so that with respect to the elastic behaviour as well as with regard to the bending endurance optimum properties are present. This is particularly true, when the circumference of the part-circle is at least 70% of the circumference of a complete circle of the same diameter. A further improvement in the elastic behaviour can in this connection be achieved if the ratio of the diameter of the part-circle described by each of the holding arms to the diameter of the rod steel is 3 to 8.

A resilient member with a reduced space requirement for its fitting and at the same time minimised weight, but nevertheless good elastic properties can also be obtained in that the curvature of each of the holding arms describes at least a part-ellipse. In order to secure optimum elastic properties of holding arms formed such, it is favourable if also in this case the circumference of the part-ellipse is at least 70% of the circumference of a complete ellipse, having axes of the same lengths. Additionally, the ratio of the means of the lengths of the axes of the part-ellipses described by each of the holding arms to the diameter of the rod steel can be 3 to 8, in order to achieve further improved properties of the holding arms being formed part-ellipsical. These can also be supported in that the ratio of one axis of the part-ellipse to its other axis is 0.5 to 2.

According to a further variant being particularly advantageous with regard to production as well as in practical operation, seen from the side, when the resilient element is not clamped, the central portion extends in a first plane and the holding arms extend in a second plane which is oblique to the first plane. Unlike according to the prior art neither the central portion nor the holding arm are constructed arched. Instead the central portion and the holding arms extend in respectively one plane, so that in the side view they respectively have a straight progression. Thereby, the planes of the respectively present holding arms and the central portion are arranged oblique to one another, so that the holding arms and the central portion, seen from the side, enclose an angle between them. When clamping the resilient member the central portion and the holding arms are moved against each other, so that the angle enclosed between their planes decreases. Best results are achieved, when with an unclamped resilient member, the angle made between the planes is 5° to 40°.

Further material savings can be achieved when the clear distance from the free ends of the holding arms to the central portion is more than the thickest diameter of the resilient member. This measurement is based on the perception that, unlike assumed in the prior art, in practice it is not necessary to avoid an interlinking or interlocking of resilient members being collected in a container, but instead that the weight saving achieved in this manner accounts for much more.

A particularly good fittability of a resilient member of the above presented type, used in a system according to the invention, at the same time as good functionality and low space requirement results, if the radius of the curvature of the holding arms is more than half the length of the legs of the central portion. With this dimensioning it is ensured that the free ends of the holding arms in each case end on the level of the bent partial section of the U-shaped central portion. The concerned free ends, which transfer the holding forces exerted by the resilient member onto the rail, can thus be laid onto the respective rail flange in an easy manner. At the same time the clamping member used for clamping the resilient member and acting directly on the central portion can be mounted close to the rail to be fastened.

Further advantageous embodiments of a fastening system according to the invention and its individual components become apparent from the following description of an exemplary embodiment. For this purpose reference is made to a drawing, in which schematically the following is represented, respectively:

DETAILED DESCRIPTION OF THE DRAWINGS

Figure 1A:
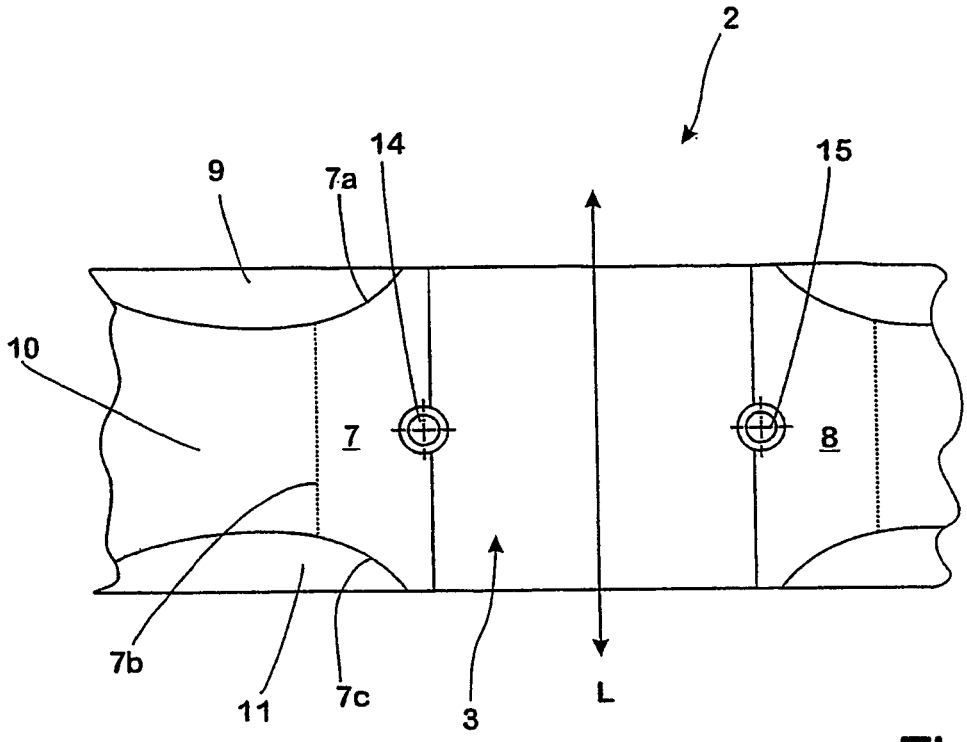
FIG. 1*a* a partial view of a sleeper for fastening a rail in a plan view.
Figure 1B:
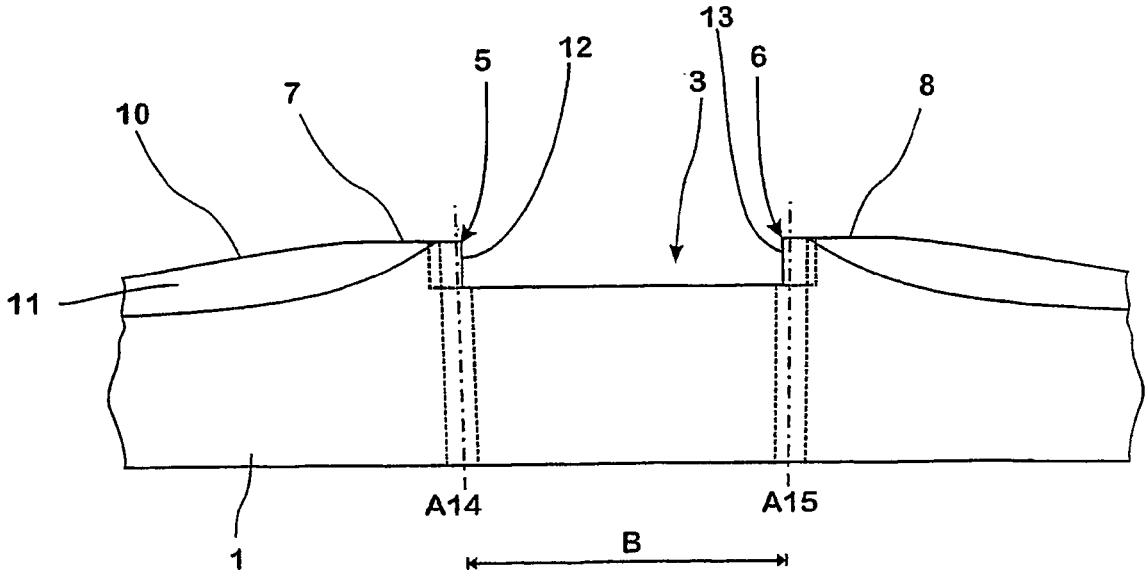
FIG. 1*b* the partial view of the sleeper according to FIG. 1*a* in a side view.

The sleeper 1 is made from a concrete material. It possesses a basic form, which is per se known from the concrete sleepers already used in the prior art. Accordingly, the sleeper 1, in the area of its lateral ends possesses two fastening zones 2, of which only one is shown here. The fastening zones 2 serve for fastening respectively one rail S.

In each fastening zone 2 for this purpose a supporting face 3 is formed, onto which in the fully fitted state the flange Sf of the rail S to be fastened is supported.

The width B of the supporting face 3, measured transversely to the longitudinal extent L of the rail S to be mounted on the sleeper 1 is larger than the width Bsf of the flange Sf of the rail S. At its lateral ends, extending parallel to the longitudinal extent L the supporting face 3 merges in a respectively step-like transition 5,6 into respectively one levelling face 7,8, which, when the sleeper 1 is set up in the fitted state, with regard to the level of the supporting face 3, lies higher than the supporting face 3.

The levelling faces 7,8 are designed evenly, and at their edges 7*a*,7*b*,7*c* remote from the supporting face, respectively merge stepless into draining faces 9,10,11, declining laterally and in the direction of the width of the sleeper 1. Rain water that hits the levelling faces 7,8 and the components fastened on them, can thus drain unobstructedly and seep into the surrounding of the sleeper 1.

The transitions 5,6 are formed step-like, so that between the respective levelling face 7,8 and the supporting face 3 in each case a force-carrying surface 12,13 is formed. The force-carrying surfaces 12,13 are essentially arranged perpendicularly to the supporting face 3, so that the supporting face 3 includes an angle of respectively approximately 90° with the respective force-carrying surface 12,13.

In the area of the transitions 5,6, starting from the respective levelling face 7,8, a respective formed element 14,15, in the form of a bore-like sinking, is formed into the sleeper 1 for fastening a clamping screw P serving as a clamping member. The respective formed elements 14,15 are thereby arranged centrally to the sleeper 1, with respect to the longitudinal extension L, and with their circumference intersect the respective force-carrying surface 12,13. Their longitudinal axes A14,A15, however, are arranged respectively displaced towards the respective levelling face 7,8, so that in the fully fitted fastening system the axis W along which the clamping force F exerted and/or absorbed by the clamping screw P acts, which axis W falls together with the longitudinal axes A14, A15, passes through the respective levelling face 7,8 behind the respective transition 4,5,6, seen from the supporting face 3. In order to allow for the fastening of the clamping screw P in the sleeper 1, into the formed elements 14, 15 in each case a plastics plug, known per se and not shown here, can be inserted. At the same time the formed elements 14,15 can, like in the exemplary embodiment shown here, be arranged sloped with a slight angle deviation to the perpendicular, so that their axes A14,A15 meet in a point, not shown here, lying far below the supporting face 3. Such an oblique arrangement allows in an optimised manner, via a clamping screw P used as a clamping member, to exert the forces necessary to clamp resilient members 100,101.

The sleeper 1 embodied in the manner explained above allows for the introduction of the force required for clamping of the respectively used resilient member 100,101 at a position of the sleeper 1, which lies beyond the border of the transition 4,5 of the supporting face 3 to the respective levelling face 7,8. Accordingly the location on the sleeper 1 provided for the fastening of the clamping screw P acting respectively as a clamping means at least on the border of the transition 4,5 between the supporting face 3 and the respective levelling face 7,8, and this so, that the axis W, via which the force exerted or absorbed by the clamping screw P does not pass through the supporting face 3 first, but instead passes first through the respective levelling face 7 and 8, respectively.

A sleeper 1 according to the invention is in this manner embodied such, that the force F clamping the respective resilient member 100,101, seen from the supporting face 3, is introduced behind the face 12 and 13, respectively, of the sleeper 1, which face 12,13 laterally limits the supporting face 3 in the area of the respective transition 4,5 to the respective levelling face 7,8. In this fashion the sleeper 1 according to the invention is embodied such, that the angled mounting plates 20,21 provided for lateral support of the rail S can be supported in the area of the transition 4,5 without the means (clamping screw P) used for clamping the resilient member 100,101 being stressed.

The angled mounting plates 20,21 belonging to the fastening system each possess a central portion 22, onto the underside 23 of which a support surface 24 is formed. During fitting of the rail S the respective angled mounting plate 20,21 with this support surface 24 is placed onto the levelling face 7,8, in each case assigned to it, of the sleeper 1.

A supporting portion 25 is formed onto the central portion 22 pointing downwards from its underside. The width Bst of the supporting portion 25 is thereby considerably larger than the width Bz of the central portion 22 arranged centrally to the supporting portion 25, seen in the plan view.

Figure 2A:
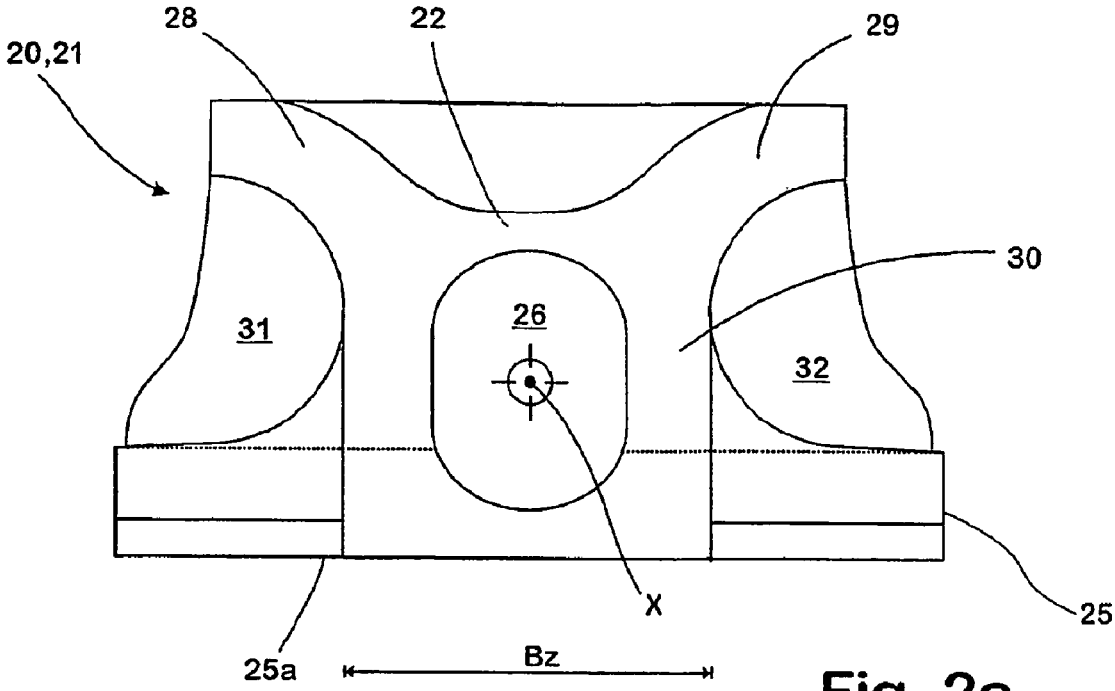
FIG. 2*a* an angled mounting plate used for fastening the rail in a plan view.
Figure 2B:
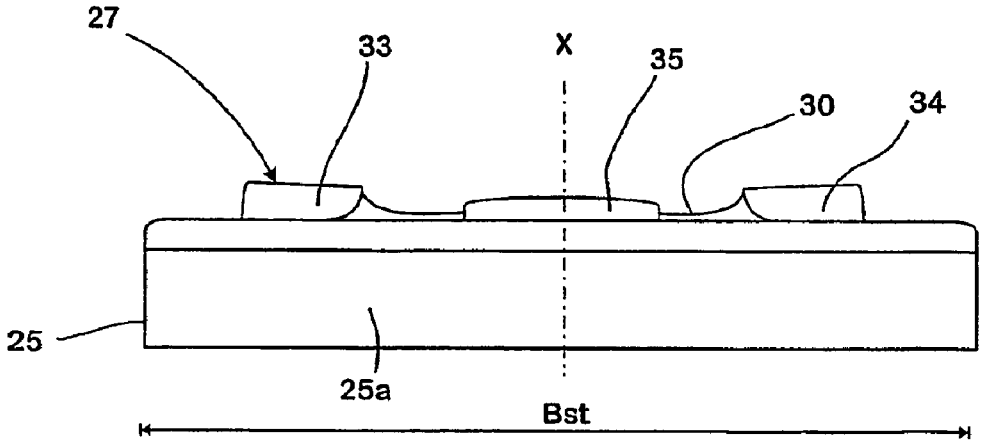
FIG. 2*b* the angled mounting plate in a front view.
Figure 2C:
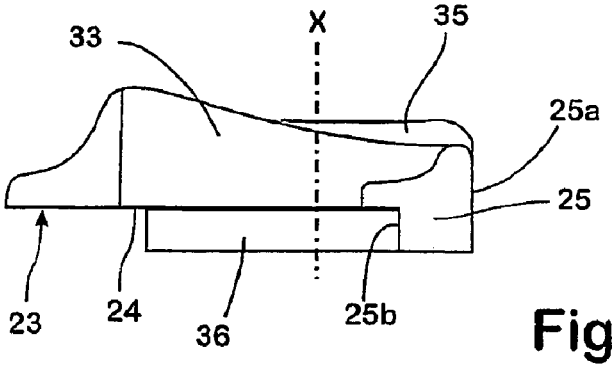
FIG. 2*c* the angled mounting plate in a side view.

The supporting portion 25 has a first contact face 25*a*, which comes into contact with the rail S in the fitted state and a second contact face 25*b* lying opposite to the first contact face 25*a*, which second contact face 25*b* abuts the sleeper 1 in the fitted state. In the angled mounting plate shown in FIGS. 2*a*,2*b* the supporting portion 25 extends over the entire width of the respective mounting plate 20,21.

Additionally, into the central portion 22 a through-opening 26 is formed for the respective clamping screw P acting as clamping means. The specialty of the mounting plate 20,21 lies in the fact, that the central axis X of the through-opening 26, passing through the central portion 22, runs outside the supporting portion 25 and adjacent to its second contact face 25*b*. According to the arrangement of the force-carrying faces 12,13 the second contact face 25*b* is thereby arranged such towards the support surface 24, that between the support surface 24 and the second contact face 25*b* an angle of 90° is included. Of course the second contact face 25*b* and the support surface can also be arranged towards another differently, if this proves to be favourable due to a corresponding forming of the sleeper 1 or an advantageous force flow. Preferably the concerned angle is at 110°.

On its upper side 27, lying opposite its underside 23, the central portion 22 of the angled mounting plates 20,21 has formed elements for the guiding of the resilient member 100,101 seatable on the respective mounting plate 20,21 for exerting a holding force H onto the rail S. These formed elements are on the one hand designed in the form of material thickenings being vaulted flute-like, according to the diameter D of the resilient members 100,101, which thickenings extend as legs 28,29 in a curve from the central portion 30 of the respective mounting plate 20,21, which central portion 30 surrounds the through-opening 26 and is also thickened. The central portion 30 thereby extends starting from the first contact face 25*a* at a right angle to the supporting portion 25.

The legs 28,29 are connected to the corner areas of the side of the central portion 30, which is facing away from supporting portion 25. The sections 31,32 of the mounting plates 20,21 respectively limited by the legs 28,29 and the supporting portion 25 are each filled with a thin layer of the plastics material, from which the angled mounting plates 20,21 are made. In fully fitted mounting plates 20,21 these layers represent a barrier for moisture, which moisture collects on the sleeper 1.

On their edges associated with the sections 31,32 respective webs 33,34 are formed onto the legs 28,29. These webs 33,34 represent a protection against twisting, slipping and spreading for the resilient member 100,101 positioned on the respective mounting plate 20,21. For the same purpose a collar 35 extending around the edge of the through-opening 26 is formed on the central portion 30. This collar 35 additionally secures that water, which collects on the central portion 30 can not enter the through-opening 26.

For improving the isolation of the mounting plates 20,21 against the sleeper 1, on the underside 23 of the respective angled mounting plate 20,21 a collar 36 is formed which at least partially, preferably completely, encompasses the edge of the through-opening 26.

As resilient members 100,101 for producing the holding force H in the rail fastening system shown in the drawing two tension clamps are used, which each have a U-shaped central portion 102, whose legs 103,104 of the central portion 102, merge into respectively one holding arm 105,106. Essential feature of the resilient members 100,101 is thereby, that the holding arms 105,106, starting from the leg 103 or 104 assigned to it respectively, are bent into a curve moving away in a lateral direction which extends continuously and without deviations through more than 180° to such an extent, that their free ends 105*a*, 106*a* are pointing in the direction of the central portion 102. Generally, for this a bending of more than 200° is necessary. Thus, the angle range encompassed by the bending of the holding arms 105,106, in the embodiment shown here, amounts to respectively at least 270°.

Figure 3A:
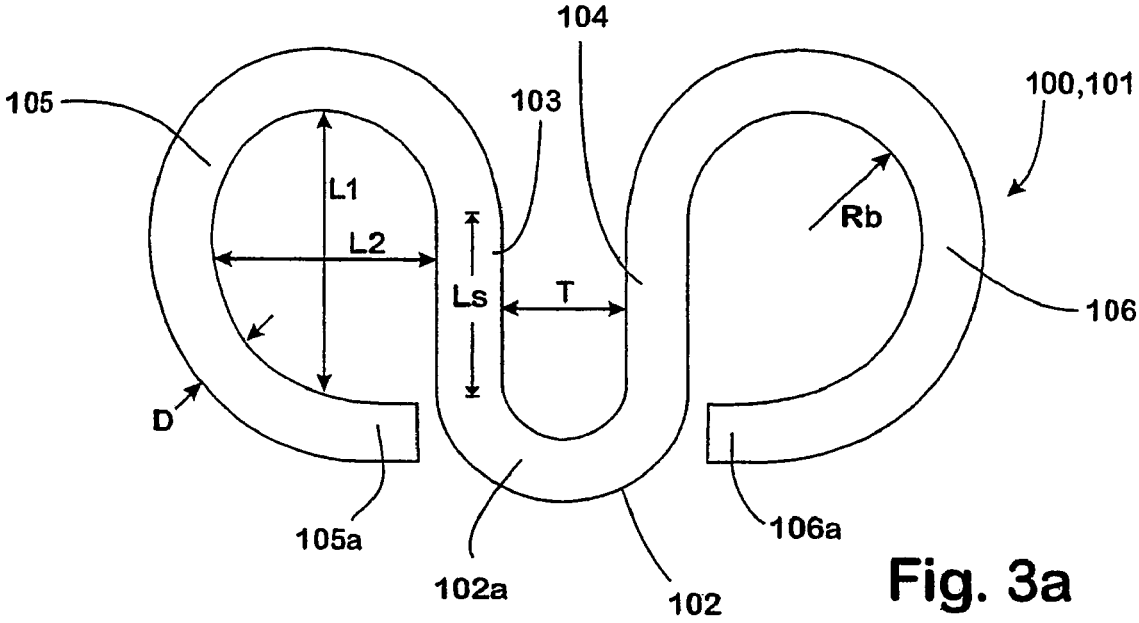
FIG. 3*a* a tension clamp used for fastening the rail in a plan view.
Figure 3B:
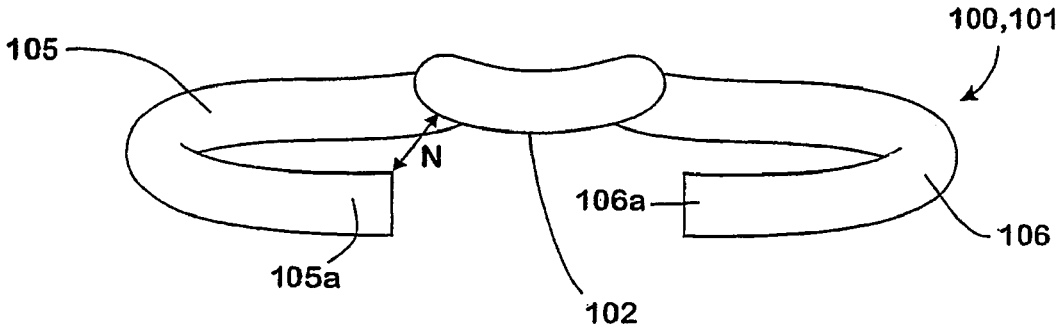
FIG. 3*b* the tension clamp in a front view.

The radius Rb of the bending, with which the holding arms 105,106 are curved, starting from the leg 103,104 holding it, is always larger than half the clear width T between the legs 103,104. At the same time the bending of the holding arms 105,106 is led so far, that their free ends 105*a*,106*a* seen in the plan view (FIG. 3*a*) are directed against the central portion 102. In the embodiment shown, the curve of the bending of the holding arms 105,106 is outlayed such, that the free ends 105*a*,106*a* of the holding arms 105,106, seen in the plan view, end approximately at the level of the bent connection section 102*a*, which connects the legs 103,104 of the U-shaped central portion 102. Seen in the plan view, accordingly the extent L1, measured parallel to the respective leg 103,104, of the area U limited by the holding arms 105,106, i.e. the area along which the holding arms 105,106 respectively extend laterally, is in each case larger than the length Ls of the leg 103,104 of the central portion 102, which leg is assigned to the respective holding arm 105,106. Through each one of these features optimised elastic properties of the resilient members 100,101 at simultaneously optimised fittability are achieved.

The continuously bent forming without deviation of the holding arms 105,106 and the also continuously bent transition without deviations from the legs 103,104 of the central portion 102 into the holding arm 105,106, respectively associated with it, supports these optimised elastic properties of the resilient members 100,101. Thus the holding arms 105, 106 act in the form of elastic springs, which for the most part are stressed by torsion. This uniform stress situation leads to a considerably increased permanent loadability at simultaneously increased elasticity. Through the forming of the resilient members 100,101 and the conscious dispensing with any constriction or narrowing for example in the area of the central portion, it is thus achieved that the resilient members 100,101 also after long operational times still exert the holding force H necessary for holding the rail S.

The resilient members 100,101 are preferably constructed from a rod steel. Rod steels are easily deformed by bending and have good elastic properties in the bent state.

A particularly simple forming of the holding arms 105,106 would result, if the bending of the holding arms 105,106 in the plan view respectively describes a part-circle. For the holding arms 105,106 shown in the drawing, however, a part-ellipsical form has been chosen, in order to provide resilient members 100,101 building as narrow as possible.

Independent of which form the holding arms 105,106 obtain, they are preferably arranged such, that the circumference of the part-figure (part-ellipse, part-circle) formed by them is at least 70% of the circumference of the corresponding full-figure (full-ellipse, full-circle) with the same diameter. Holding arms 105,106 being thus designed have an elastic flexibility, through which the vertical deformations of the rail S occurring during operation can be absorbed in a particularly secure manner. In the embodiment shown, additionally the ratio (L1+L2)/2:D of the means of the axial lengths L1,L2 of the axes of the part-ellipses formed by each of the holding arms 105, 106 to the diameter D of the rod steel is 3 to 8. This dimensioning also supports the elastic properties of the resilient members 100,101. The same results with a circular bending of the holding arms 105,106, if there the ratio of the diameter of the circle encompassed by each of the holding arms 105, 106 to the diameter D of the rod steel is 3 to 8.

A further optimisation of the elastic properties of the resilient members 100,101, in the embodiment shown here, has been achieved in that the ratio of one axis L1 to the other axis L2 of the part-ellipse encompassed by the holding arms 105, 106 is 0.5 to 2.

Figure 3C:
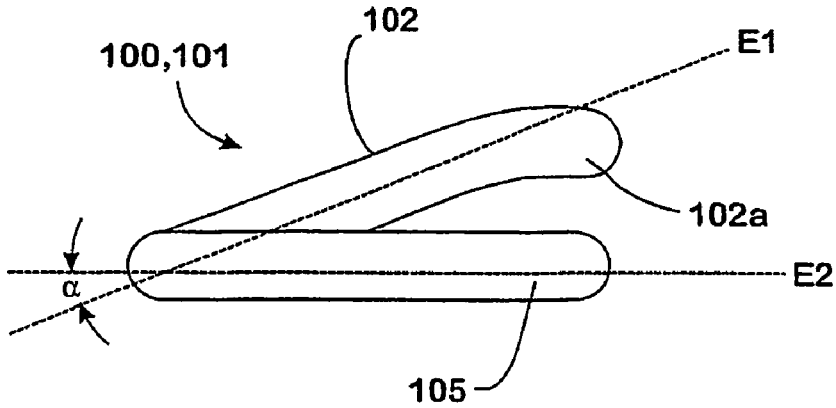
FIG. 3*c* the tension clamp in a side view.
Figure 3D:
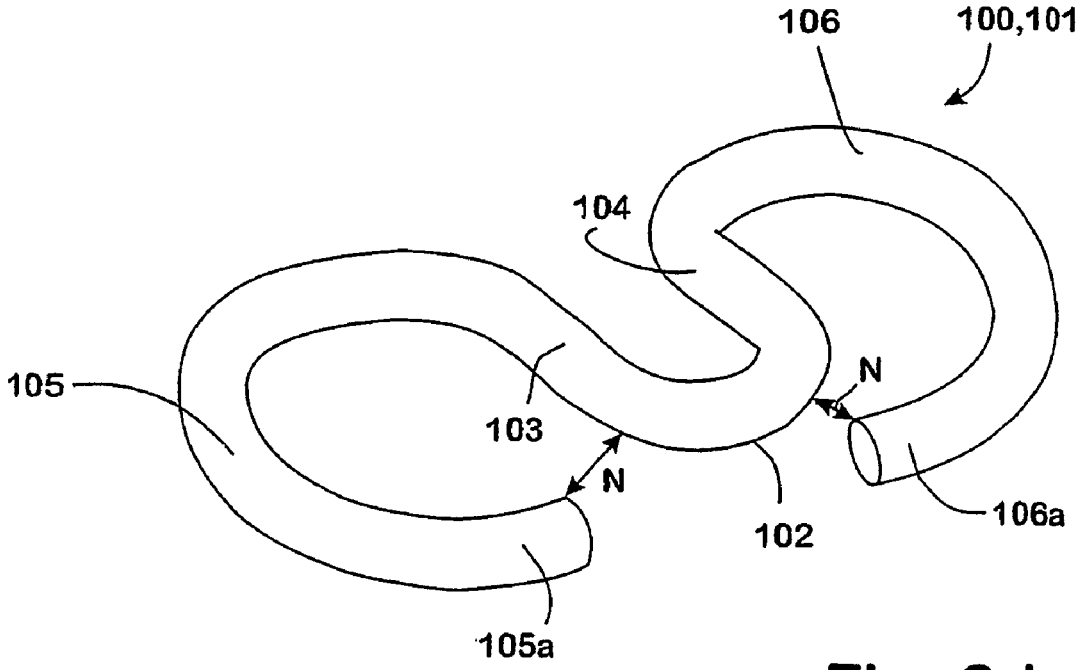
FIG. 3*d* the tension clamp in a perspective view.

A further specialty of the resilient members 100,101 used in the exemplary embodiment, being particularly advantageous in combination with the forming of the sleeper 1 and the angled mounting plates 20,21, lies in that, when the resilient element 100,101 is not clamped, the major part of the central portion 102 extends in a first plane E1 and the holding arms 105,106 for their major part extend in a second plane E2, which is oblique to the first plane E1. In this respect the angle α made between the planes E1,E2 is preferably 5° to 40° (FIG. 3*c*).

The resilient members 100,101 used in the embodiment in combination with the sleeper 1 are not only characterised by optimised elastic properties, but also by a minimised weight. This is in particular achieved through the continuous guiding of the bending, by which the overall length of the rod steel used for the production of the resilient members 100,101 is reduced to a minimum. A further weight reduction can thereby achieved in that the free distance N of the free ends 105*a*,106*a* of the holding arms 105,106 to the central portion 102 is in each case larger than the thickest diameter D of the resilient members 100,101.

For fastening the rail S on the sleeper 1 the fastening system consisting of the sleeper 1, the angled mounting plates 20,21, the resilient members 100,101 and the clamping screws P as clamping means, being supplemented by an elastic intermediate layer Z is first prefitted. Such an intermediate layer Z produced from an elastic material is provided, if the rail S is to be supported on the supporting face 3 of the sleeper 1 with defined elasticity.

During prefitting, first the elastic intermediate layer Z is laid centrally onto the supporting face 3. Afterwards the angled mounting plates 20,21 with their support surface 24 are placed onto the levelling faces 7,8 assigned to them, respectively, such, that they abut the force-carrying surface 12 or 13, assigned to them respectively, of the sleeper 1, with the second contact face 25*b* of their support portion 25, and that their through-opening 26 is in alignment with the formed element 14,15, assigned to them, respectively, of the sleeper 1.

Figure 4A:
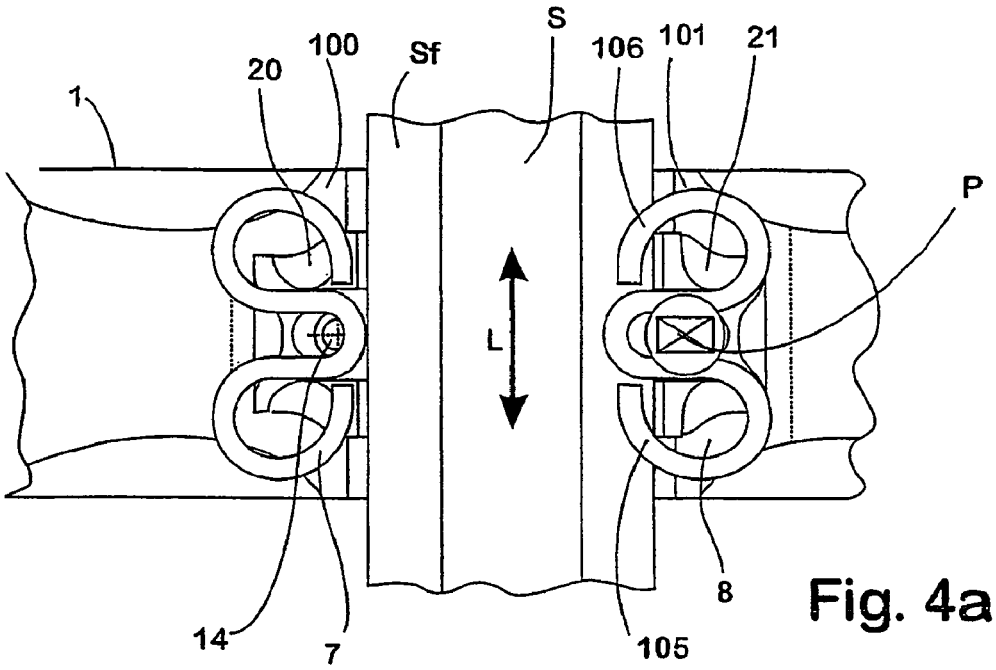
FIG. 4*a* a system for fastening the rail in a plan view.
Figure 4B:
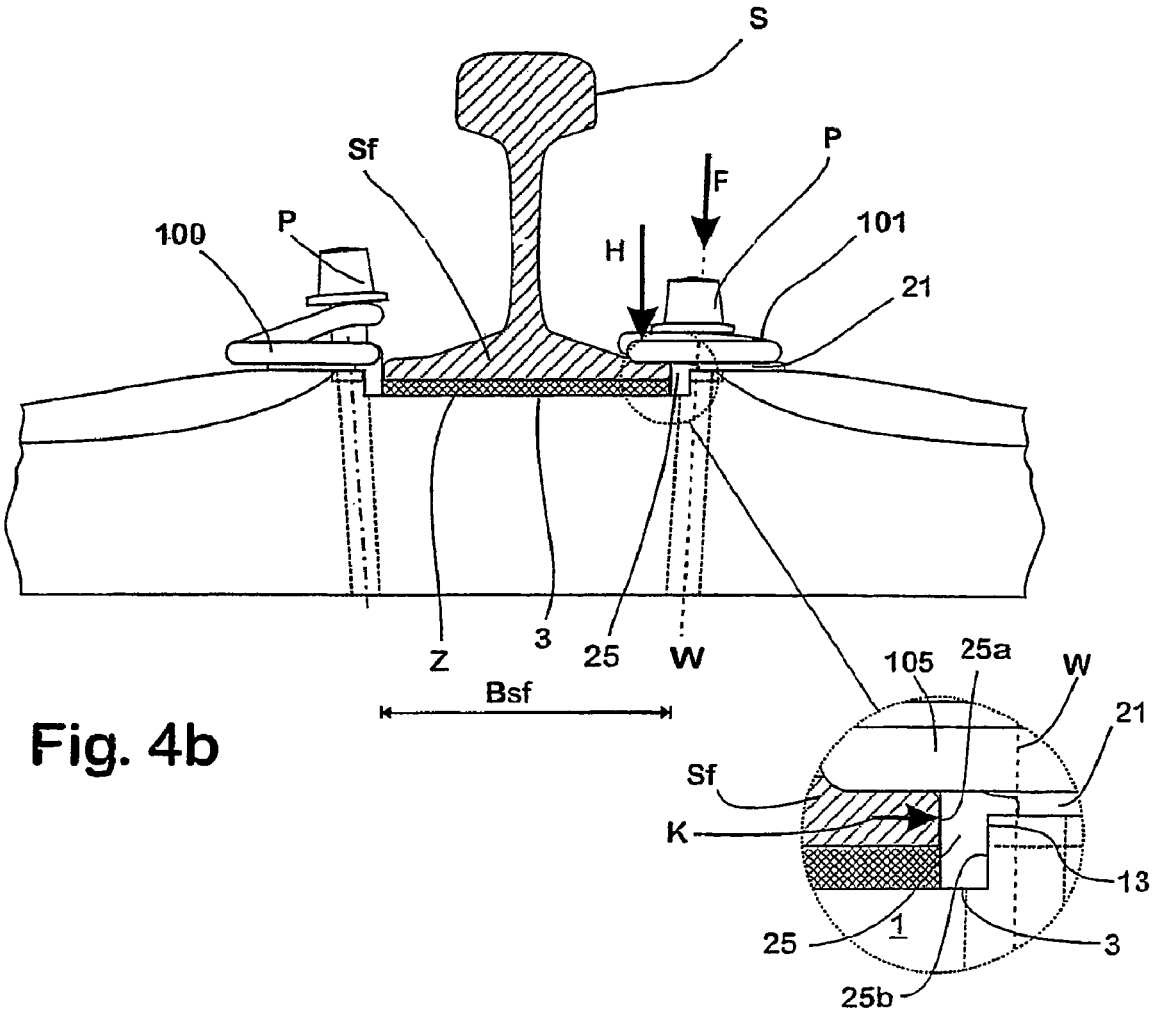
FIG. 4*b* the system in a side view.

Onto the angled mounting plates 20,21 arranged in this manner, in each case a resilient member 100,101 is placed such, that the curvature of its central portion 102 and the free ends 105*a*,106*a* of the holding arms 105,106 are directed towards the supporting face 3. In the prefitted position the resilient members 100,101 are displaced with respect to the supporting face 3 in such a manner, that the free ends 105*a*, 106*a* of the holding arms 105,106 lie on the support section 25 of the respective angled mounting plate 20,21, and the space available between the support portions 25 of the mounting plates 20,21 is free, in order to be able to insert therein without hindrance the flange Sf of the rail S to be mounted. Finally the respective clamping screw P is screwed into the formed element 14,15 of the sleeper 1, provided respectively for its fastening, until it exerts a light clamping force sufficient to hold the resilient member 100,101 in the prefitted state. The prefitted state thus produced is shown in FIGS. 4*a*,4*b* for the angled mounting plate 20 and the resilient member 100, wherein for the purpose of clarity in FIG. 4*a* the prefitted clamping screw P is not shown. The resilient member 101 and the angled mounting plate 21 as well as the corresponding clamping screw P are prefitted in a corresponding way.

After prefitting, the rail S is placed onto the intermediate layer Z lying on the supporting face 3. The rail S thereby fills the space available between the angled mounting plates 20,21, so that with the sides of its flange Sf, it respectively abuts tightly on the first contact faces 25*a* of the supporting portion 25 of the angled mounting plates 20,21. Subsequently the resilient members 100,101 are displaced in the direction of the rail flange Sf, until their holding arms 105,106 with their free ends lie on the rail flange Sf. Afterwards, the clamping screws P are tightened. In this way, the central portion 102 of the resilient members 100,101 are clamped against their holding arms 105,106, until the central portion 102 lies upon the central portion of the respective angled mounting plate 20,21.

In this fully clamped state the holding arms 105,106 of the resilient members 100,101 exert the holdings forces H, necessary for the safe holding of the rail S against excessive movements in the vertical direction, onto the flange Sf from opposite sides. Thereby they are stressed in the manner of an elastic spring essentially exclusively by torsion. Simultaneously their elastic flexibility is sufficient, in order to securely compensate for the unavoidable vertical movements of the rail S during operation. The lateral guiding forces K occurring during operation are absorbed by the supporting portions 25 of the mounting plates 20,21, and are directly transferred into the sleeper 1 via the respective force-carrying surface 12 or 13. The clamping screws P as well as the central portion 22 of the angled mounting plates 20,21 are in this way kept free of the lateral forces K, so that they also are subject to little wear and thus have a correspondingly long lifetime.

| REFERENCE NUMERALS | |
|---|---|
| 1 | Sleeper |
| 2 | Fastening zones |
| 3 | Supporting face |
| 5,6 | Transition |
| 7,8 | Levelling faces |
| 7a,7b,7c | Edges of the levelling face 7 |
| 9,10,11 | Draining faces |
| 12,13 | Force-carrying surfaces |
| 14,15 | Formed elements (sinking) for fastening the clamping screw P |
| 20,21 | Angled mounting plates |
| 22 | Central portion of the angled mounting plates 20,21 |
| 23 | Underside of the central portion 22 |
| 24 | Support surface 24 of the angled mounting plates 20,21 |
| 25 | Supporting portion |
| 25a,25b | Contact faces of the supporting portion |
| 26 | Through-opening |
| 27 | Upper side of the angled mounting plates 20,21 |
| 28,29 | Legs of the angled mounting plates 20,21 |
| 30 | Central portion of the angled mounting plates 20,21 |
| 31,32 | Sections of the angled mounting plates 20,21 |
| 33,34 | Webs |
| 35 | Collar |
| 36 | Collar |
| 100,101 | Resilient members |
| 102 | Central portion of the resilient members 100,101 |
| 102a | Bent partial section of the central portion |
| 103,104 | Legs of the resilient members 100,101 |
| 105,106 | Holding arms of the resilient members 100,101 |
| 105a,106a | Free ends of the holding arms 105,106 |
| □ | Angle made between the planes E1,E2 |
| A14,A15 | Longitudinal axes of the formed elements 14,15 |
| B | Width of the supporting face 3 |
| Bsf | Width of the flange Sf of the rail S |
| Bst | Width of the supporting portion 25 |
| Bz | Width of the supporting portion 25 |
| D | Diameter of the rod steel, from which the resilient members 100,101 are produced |
| E1,E2 | Planes |
| F | Clamping force exerted by the clamping screw P |
| H | Holding force exerted by the resilient members 100,101 |
| K | Lateral forces |
| L | Longitudinal extent L of the rail S |
| Ll,L2 | Axial lengths of the part-ellipses respectively formed by the holding arms 105,106 |
| Ls | Length of the legs 103,104 of the central portion 102 |
| N | Free distance of the free ends 105a,106a of the holding arms 105,106 to the central portion 102 |
| P | Clamping screw |
| Rb | Radius of the curvature, with which the holding arms 105,106 starting from the leg 103,104 carrying them are bent |
| T | Clear width between the legs 103,104 |
| S | Rail |
| Sf | Flange of the rail S |
| U | Area respectively limited by the holding arms 105,106 |
| W | Axis along which the clamping force F acts |
| X | central axis of the though-opening 26 |
| Z | Elastic intermediate layer |

The invention claimed is:

1. A system for fastening a rail, comprising:

a sleeper which has a supporting face intended to support a flange of the rail, the supporting face merging, at legs which extend parallel to a longitudinal extent of the rail to be fastened to the legs, into respective levelling faces which are situated at a higher level than the supporting face, an angled mounting plate which has, in each case, a central portion, on an underleg of which is formed a support surface by which the angled mounting plate can be placed down on the respective levelling face, and a supporting portion which is formed onto the central portion and points downwards from the underleg of the central portion and which, when the system is fully fitted, bridges a clear space between the flange of the rail and the respective levelling face, a resilient member which can be placed down on the angled mounting plate and which has, in each case, two holding arms by which, when the system is fully fitted, the resilient member exerts a holding force on the rail, and a clamping member which, when the system is fully fitted, exerts a clamping force on the resilient member, wherein, when the system is fully fitted, an axis along which the clamping force exerted by the clamping member acts passes through the respective levelling face.

2. The system of claim 1, wherein, on the sleeper, there is associated with each respective levelling face a formed element for fastening the clamping member in place, which clamping member, when the rail is fitted, holds clamped, with the clamping force the resilient member which exerts the holding force on the rail, and in that, in relation to a transition between the supporting face and the respective levelling face, each of the formed elements is arranged to be spaced away from the supporting face in a direction of the respective levelling face in such a way that, when there is the clamping member fastened to the sleeper, the axis along which the clamping force produced by the clamping member acts passes through the respective levelling face associated with the formed element.

3. The system of claim 2, wherein, on the sleeper, the transition between the supporting face and the respective levelling face is of a stepped form.

4. The system of claim 3, wherein the supporting face is bounded, at the legs, by respective force-carrying faces, and in that an angle made between the force-carrying faces and the supporting face is 75° to 105°.

5. The system of claim 3, wherein an angle between the force-carrying faces and the supporting face is 85° to 95°.

6. The system of claim 2, wherein, on the sleeper, the supporting face and the respective levelling face are positioned in planes arranged parallel to one another.

7. The system of claim 2, wherein, on the sleeper, at least one surface which adjoins the respective levelling face and is remote from the supporting face is formed to slope down from the respective levelling face.

8. The system of claim 7, wherein the surface which adjoins the respective levelling face merges steplessly into the respective levelling face.

9. The system of claim 2, wherein the sleeper is produced from a concrete material, a plastics material or a mixed material.

10. The system of claim 2, wherein the formed element for fastening the clamping member in place comprises an opening formed in the respective levelling face of the sleeper.

11. The system of claim 1, wherein the supporting portion has a first contact face which comes to bear against the rail in a fitted position, and a second contact face situated opposite the first contact face which rests against the sleeper in the fitted position, and a through-opening formed in the central portion for the clamping member, a centre axis of which through-opening, passing through the central portion, extends outside the supporting portion and adjacent to the second contact face.

12. The system of claim 11, wherein an angle made between the support surface and the second contact face of the angled mounting plate of the supporting portion is 75° to 120°.

13. The system of claim 11, wherein, on an upper leg opposite from the underleg, the central portion has formed elements for mounting the resilient member for applying the holding force to the rail, which resilient member can be placed down on the angled mounting plate.

14. The system of claim 11, wherein a collar, which extends round at least a portion of an edge of the through-opening, is formed on the underleg of the angled mounting plate.

15. The system of claim 11, wherein there is arranged on the angled mounting plate, in a region of an edge of the through-opening associated with the upper leg of the central portion, a collar projecting from the upper leg.

16. The system of claim 15, wherein the collar extends round the edge of the through-opening.

17. The system of claim 11, wherein there are formed on the central portion of the angled mounting plate mounting portions for the resilient member which extend away laterally from the central portion.

18. The system of claim 11, wherein a width of the central portion of the angled mounting plate is less than a width of the supporting portion.

19. The system of claim 11, wherein the angled mounting plate is produced from a plastics material.

20. The system of claim 11, wherein an angle made between the support surface and the second contact face of the angled mounting plate of the supporting portion is 100° to 115°.

21. The system of claim 1, wherein the resilient member has a U-shaped central portion whose legs merge into a respective one of the holding arms of the resilient member, which holding arms, starting from the legs of the central portion which are respectively associated with the holding arms and moving away in a lateral direction, are bent into a curve which extends continuously and without deviations through more than 180° and whose radius is more than half a clear width between the legs of the central portion.

22. The system of claim 21, wherein, seen in plan, an extent as measured parallel to a leg of the resilient member, of a region which is defined by the holding aims is in each case greater than a length of the leg of the central portion which is associated with the holding arm.

23. The system of claim 21, wherein the curve of the holding arms is continued sufficiently far for free ends of the holding arms to be directed towards the central portion when seen in plan.

24. The system of claim 21, wherein the resilient member comprises rod steel.

25. The system of claim 21, wherein, seen in plan, the curve of each of the holding arms describes at least a part-circle.

26. The system of claim 25, wherein a circumference of the part-circle is at least 70% of a circumference of a complete circle of identical diameter.

27. The system of claim 25, wherein a ratio of a diameter of the part-circle described by each of the holding arms to a diameter of the rod steel is 3 to 8.

28. The system of claim 21, wherein the curve of each of the holding arms describes at least a part-ellipse.

29. The system of claim 28, wherein a circumference of the part-ellipse is at least 70% of a circumference of a complete ellipse having axes of identical lengths.

30. The system of claim 28, wherein a ratio of a mean of axes lengths of the part-ellipses described by each of the holding arms to a diameter of the rod steel is 3 to 8.

31. The system of claim 28, wherein a ratio of one axis of the part-ellipse to the part-ellipse's other axis is 0.5 to 2.

32. The system of claim 21, wherein, when the resilient member is not clamped, the central portion extends in a first plane and the holding arms extend in a second plane which is oblique to the first plane.

33. The system of claim 32, wherein an angle made between the first and second planes is 5° to 40°.

34. The system of claim 21, wherein a clear distance from free ends of the holding arms to the central portion is more than a thickest diameter of the resilient member.

35. The system of claim 21, wherein the radius of the curve of the holding arms is more than half a length of the legs of the central portion.

* * * * *

UNITED STATES PATENT AND TRADEMARK OFFICE

CERTIFICATE OF CORRECTION

PATENT NO. : 7,854,392 B2
APPLICATION NO. : 11/632154
DATED : December 21, 2010
INVENTOR(S) : Hauschild et al.

It is certified that error appears in the above-identified patent and that said Letters Patent is hereby corrected as shown below:

In claim 22, at column 18, line 51, delete “aims” and replace it with --arms--

Signed and Sealed this
First Day of March, 2011

David J. Kappos

David J. Kappos
*Director of the United States Patent and Trademark Office*